US008646870B2

(12) United States Patent
Nishimura et al.

(10) Patent No.: US 8,646,870 B2
(45) Date of Patent: Feb. 11, 2014

(54) INKJET RECORDING APPARATUS

(75) Inventors: Hideaki Nishimura, Kanagawa (JP); Yukitoshi Tajima, Kanagawa (JP); Masaki Kato, Tokyo (JP); Kiyoshi Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/609,897

(22) Filed: Sep. 11, 2012

(65) Prior Publication Data

US 2013/0070021 A1 Mar. 21, 2013

(30) Foreign Application Priority Data

Sep. 16, 2011 (JP) ..... 2011-202989

(51) Int. Cl.
*B41J 2/165* (2006.01)
*B41J 23/00* (2006.01)

(52) U.S. Cl.
USPC ..... 347/22; 347/37

(58) Field of Classification Search
USPC ..... 347/22, 37
See application file for complete search history.

(56) References Cited

U.S. PATENT DOCUMENTS

| | | | | |
|---|---|---|---|---|
| 6,244,683 | B1 * | 6/2001 | Alvarez et al. | 347/22 |
| 2003/0207091 | A1 * | 11/2003 | Nair et al. | 428/195.1 |
| 2006/0044358 | A1 * | 3/2006 | Mita | 347/68 |

FOREIGN PATENT DOCUMENTS

| | | |
|---|---|---|
| JP | 2001-260338 | 9/2001 |
| JP | 2004-066785 | 3/2004 |
| JP | 2005-225044 | 8/2005 |

OTHER PUBLICATIONS

K. D. Budd, et al., "Sol-Gel Processing of $PbTiO_3$, $PbZrO_3$, PZT, and PLTZ Thin Films", Proc. Brit. Ceram. Soc. vol. 36, 1985, pp. 107-121.

* cited by examiner

*Primary Examiner* — Matthew Luu
*Assistant Examiner* — Alexander D Shenderov
(74) *Attorney, Agent, or Firm* — Oblon, Spivak, McClelland, Maier & Neustadt, L.L.P.

(57) ABSTRACT

An inkjet recording apparatus includes a recording head; a carriage to which the recording head is detachably mounted; and a first head protection member that is arranged on the carriage; wherein the recording head is positioned with respect to the carriage in a relative movement direction by moving the recording head relative to the carriage until a first position reference plane of the recording head and a second position reference plane of the carriage come into contact; the first head protection member is arranged at both sides in the relative movement direction of a nozzle face of the recording head and protrudes further than the nozzle face; and the first head protection member is movable with respect to the carriage in the relative movement direction and moves along with the recording head when the recording head moves relative to the carriage.

8 Claims, 7 Drawing Sheets

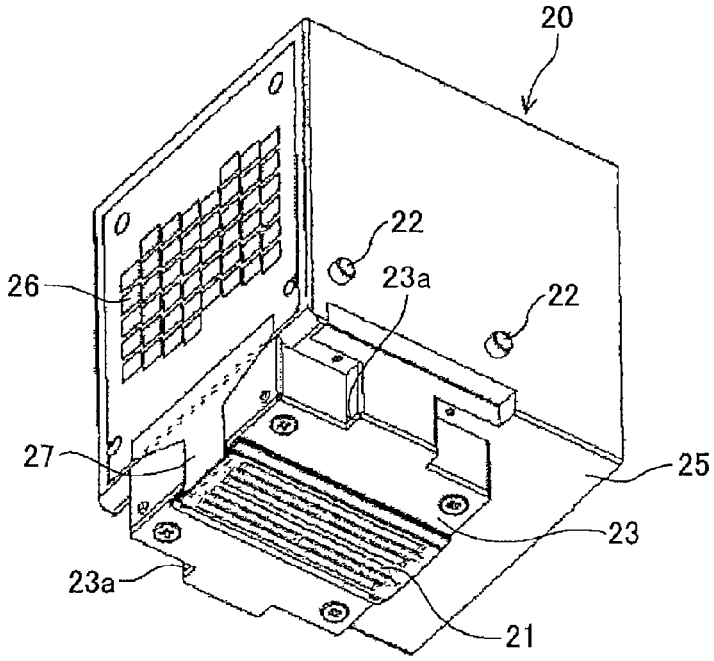
FIG.8
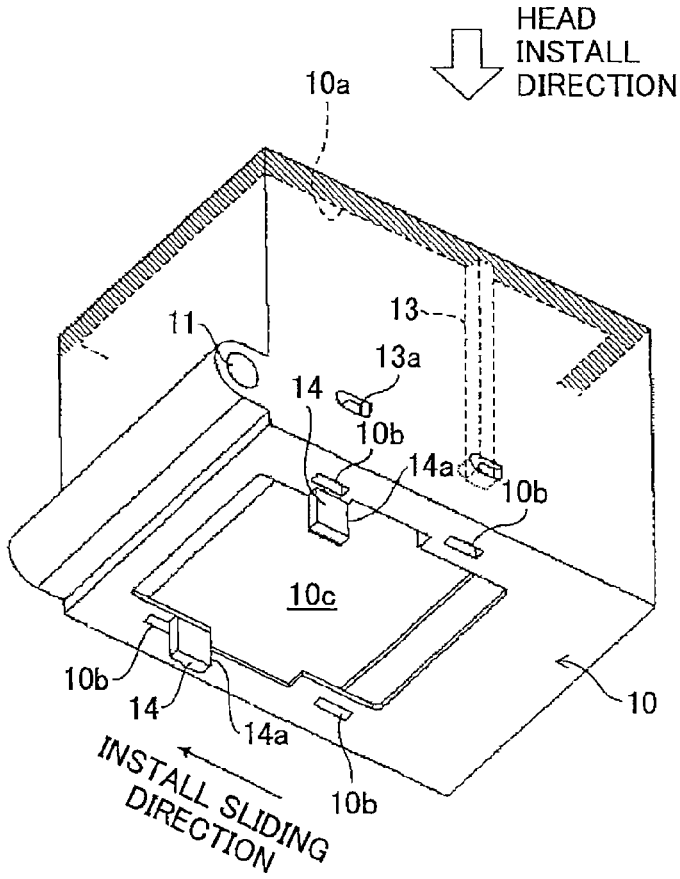

INKJET RECORDING APPARATUS

BACKGROUND OF THE INVENTION

1. Field of the Invention

The present invention generally relates to an inkjet recording apparatus that can be used as an imaging apparatus, such as a printer, a facsimile machine, and a copier.

2. Description of the Related Art

An inkjet recording apparatus can be used in products such as a printer, a facsimile machine, a copier, a plotter, and a multifunction peripheral combining a number of the above functions. An inkjet recording apparatus performs image formation (recording, printing, and imaging are sometimes synonymously used) by having a recording head discharge ink droplets onto an image recording medium. An image recording medium is not limited to paper, and may include OHP, for example. An image recording medium refers to any medium that is capable of having liquid such as ink droplets or solid matter such as toner adhered thereto. It is noted that the terms "recording medium," "recording paper," and "recording sheet" may be synonymously used.

An inkjet recording apparatus refers to an apparatus that performs image formation by discharging liquid onto an image recording medium such as paper, thread, fiber, fabric, leather, metal, plastic, glass, wood, ceramics, for example. It is noted that the term "image formation" is not limited to the rendering of an image such as characters and figures that have meaning onto an image recording medium. Rather, the term broadly encompasses the rendering of any image including an image having no meaning such as a pattern, for example. The term "ink" is not limited to that which is commonly referred to as ink, and broadly encompasses any matter that can be discharged as liquid, including DNA samples, resist, pattern materials, for example. The term "image" is not limited to that which is rendered on a planar surface, and includes an image that is rendered on a three-dimensional object, or an image that is in itself created by structuring a three-dimensional object, for example.

A recording head of an inkjet recording apparatus includes a nozzle that discharges ink droplets, a pressure chamber that is in communication with the nozzle, and pressure generating means that applies pressure on ink within the pressure chamber. The pressure generating means may be made of an electromechanical transduction element such as a piezoelectric element or an electro-thermal element such as a heater, for example. An inkjet recording apparatus forms an image on an image recording medium by applying pressure on ink within the pressure chamber with the pressure generating means and discharging ink droplets from the nozzle of the recording head. An inkjet recording apparatus may be a serial type inkjet recording apparatus that forms an image by having a recording head discharge ink droplets while moving in the main scanning direction, or a line type inkjet recording apparatus that uses a line type head and forms an image by having the recording head discharge ink droplets while the recording head is at a standstill. The serial type inkjet recording apparatus has one or more recording heads for forming an image on an image recording medium mounted on a carriage that moves back and forth in a direction intersecting the image recording medium transporting direction.

Japanese Laid-Open Patent Application No. 2004-066785 discloses a serial type inkjet recording apparatus. This inkjet recording apparatus is arranged to have a recording head that is detachable from the carriage. Configuring the recording head to be detachable from the carriage can contribute to cost reduction through improvement of assemblage efficiency during manufacturing or improvement of applicability when a user replaces the recording head. Also, this inkjet recording apparatus has two head protection plates arranged on the carriage to prevent a folded portion of the recording medium (image recording medium) from getting stuck in the periphery of flexible printed circuits that are mounted on the recording head and causing the flexible printed circuits to peel off, for example. The two head protection boards are arranged close to both sides of the flexible printed circuits in the main scanning direction, and the surfaces of the head protection boards are arranged to protrude further than the surface of the flexible printed circuits. In this way, when scanning the carriage during image formation, even if there is a folded portion of the image recording medium at the front in the scanning direction (main scanning direction), the folded portion will come into contact with the head protection boards rather than the flexible printed circuits so that failure of the recording head can be prevented.

However, the inkjet recording apparatus described in Japanese Laid-Open Patent Application No. 2004-066785 only has head protection plates arranged in the main scanning direction with respect to the nozzle face and does not have head protection plates arranged in the sub-scanning direction. It has been revealed from research by the inventors of the present invention that if the image recording medium has a mound-shaped folded portion viewed from the sub-scanning direction, for example, the top of the folded portion may override the head protection plates and come into contact with the surface of the flexible printed circuits (nozzle face of the recording head) during carriage scanning. When the folded portion of the image recording medium comes into contact with the nozzle face of the recording head, ink adhered to the nozzle face may adhere to the image recording medium thereby causing problems such as degradation of printing quality and failure of the recording head, for example.

The inventors of the present invention have discovered through diligent research that arranging head protection members such as head protection plates not only in the main scanning direction with respect to the nozzle face of the recording head but also in the sub-scanning direction would effectively prevent such problems from occurring. However, it has been revealed that if head protection members are arranged in the main scanning direction and the sub-scanning direction with respect to the nozzle face of the recording head such that the nozzle face is surrounded by head protection members on four sides, the following problems are prone to occur.

In order to ensure printing quality of the inkjet recording apparatus, ink droplets discharged from the nozzle of the recording head must land on the image recording medium with high position accuracy. In an inkjet recording apparatus having a recording head that is detachable from the carriage, the nozzle of the recording head must be positioned with respect to the carriage with high accuracy upon mounting the recording head. A common method for accurately positioning the detachable recording head with respect to the carriage is to mount the recording head to the carriage while a position reference plane arranged at the recording head and a position reference plane arranged at the carriage are in contact with each other. It is noted that in the following, a case in which the position reference planes are configured to position the recording head with respect to the sub-scanning direction is described as an example. However, the same applies to a case in which the position reference planes are configured to position the recording head with respect to the main scanning direction.

To realize the above mounting method, a configuration is desired that enables relative movement of the recording head in the sub-scanning direction with respect to the carriage so that the position reference plane of the recording head faces the position reference plane of the carriage. When head protection members on the carriage are arranged at the sub-scanning direction sides with respect to the nozzle face of the recording head, these head protection members will interfere with the relative movement of the recording head. In turn, the relative movement range of the recording head may be restricted and the relative movement operation of the recording head may be hindered so that it may be difficult to properly mount the recording head to the carriage.

On the other hand, by widening the gap between the two head protection members arranged at the sub-scanning direction sides of the nozzle face of the recording head, an adequate relative movement range for the recording head may be secured so that the relative movement of the recording head may not be hindered. However, in this case, the distance between each head protection member and the nozzle face is increased. When the distance between the head protection member and the nozzle face is increased, the head protection effect of the head protection member will decrease thereby leading to an increased possibility of a folded portion of the image recording medium coming into contact with the nozzle face.

It is noted that the above problem occurs not only in a case where head protection members are arranged at the main scanning direction sides and the sub-scanning direction sides of the nozzle face of the recording head but in any case where head protection members are arranged in the same direction as the relative movement direction of the recording head for arranging the position reference plane of the recording head to face the position reference plane of the carriage when mounting or removing the recording head.

SUMMARY OF THE INVENTION

It is a general object of at least one embodiment of the present invention to provide an inkjet recording apparatus that substantially obviates one or more problems caused by the limitations and disadvantages of the related art.

In one embodiment of the present invention, an inkjet recording apparatus is provided that includes a recording head configured to discharge ink; a carriage to which the recording head is detachably mounted, the carriage being configured to move along a direction that intersects an image recording medium transporting direction; and a first head protection member that is arranged on the carriage; wherein the recording head is positioned with respect to the carriage in a relative movement direction by moving the recording head relative to the carriage until a first position reference plane arranged at the recording head and a second position reference plane arranged at the carriage come into contact; the first head protection member is arranged at both sides in the relative movement direction of a nozzle face of the recording head and is arranged to protrude further than the nozzle face; and the first head protection member is configured to be movable with respect to the carriage in the relative movement direction and is configured to move along with the recording head when the recording head moves relative to the carriage until the first position reference and the second reference plane come into contact.

According to an aspect of the present invention, when moving the recording head relative to the carriage so that the first position reference plane of the recording head and the second position reference plane of the carriage come into contact, the first head protection member may move relative to the carriage along with the relative movement of the recording head. In this way, the head protection member may not interfere with the relative movement of the recording head so that the relative movement range of the recording head may not be restricted. In turn, the distance between the head protection members arranged at both sides in the relative movement direction of the nozzle face may be arranged to be relatively narrow so that a desirable head protection effect of the head protection members may be secured.

According to another aspect of the present invention, an adequate relative movement range for mounting the recording head may be secured without reducing the head protection effect of the head protection members.

BRIEF DESCRIPTION OF THE DRAWINGS

Other objects and further features of embodiments will be apparent from the following detailed description when read in conjunction with the accompanying drawings, in which:

FIG. 8 is a perspective view from a lower-diagonal angle of the carriage and the recording head before the recording head is installed into the carriage.

DESCRIPTION OF THE PREFERRED EMBODIMENTS

In the following, embodiments of the present invention will be described with reference to the accompanying drawings.

Figure 1:
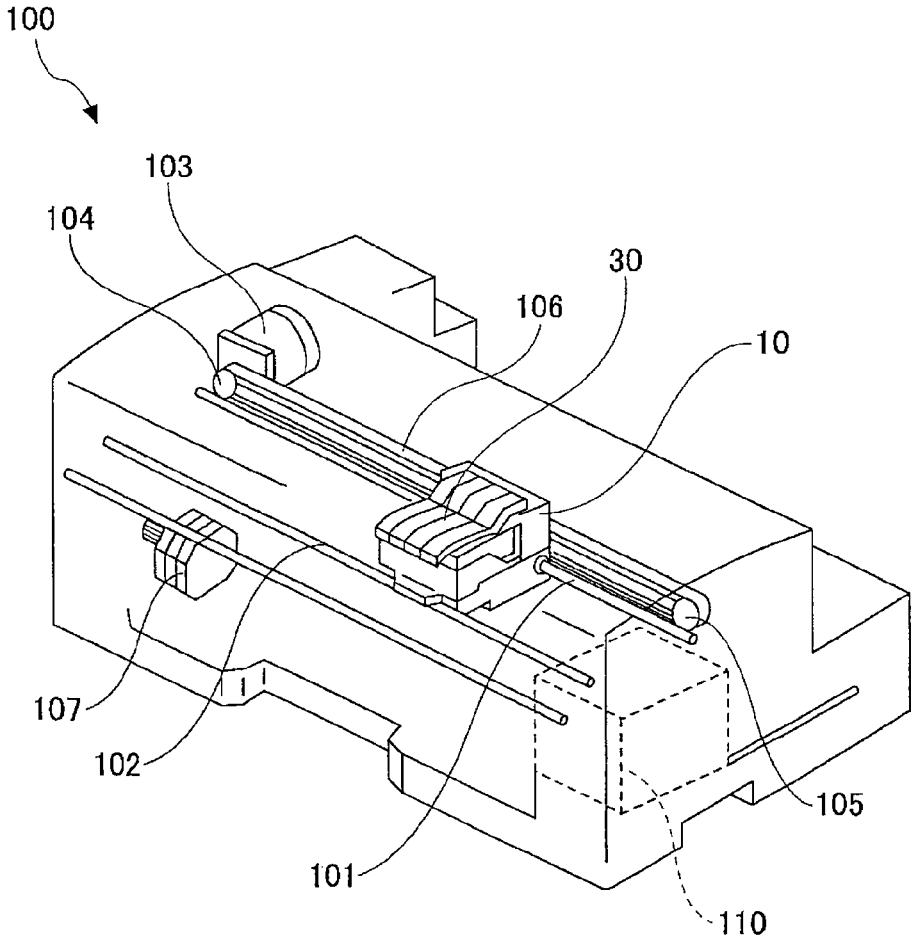
FIG. 1 is a perspective view schematically showing the internal structure of an inkjet recording apparatus according to an embodiment of the present invention.

FIG. 1 is a perspective view schematically showing the internal structure of an inkjet recording apparatus according to an embodiment of the present invention.

Figure 2:
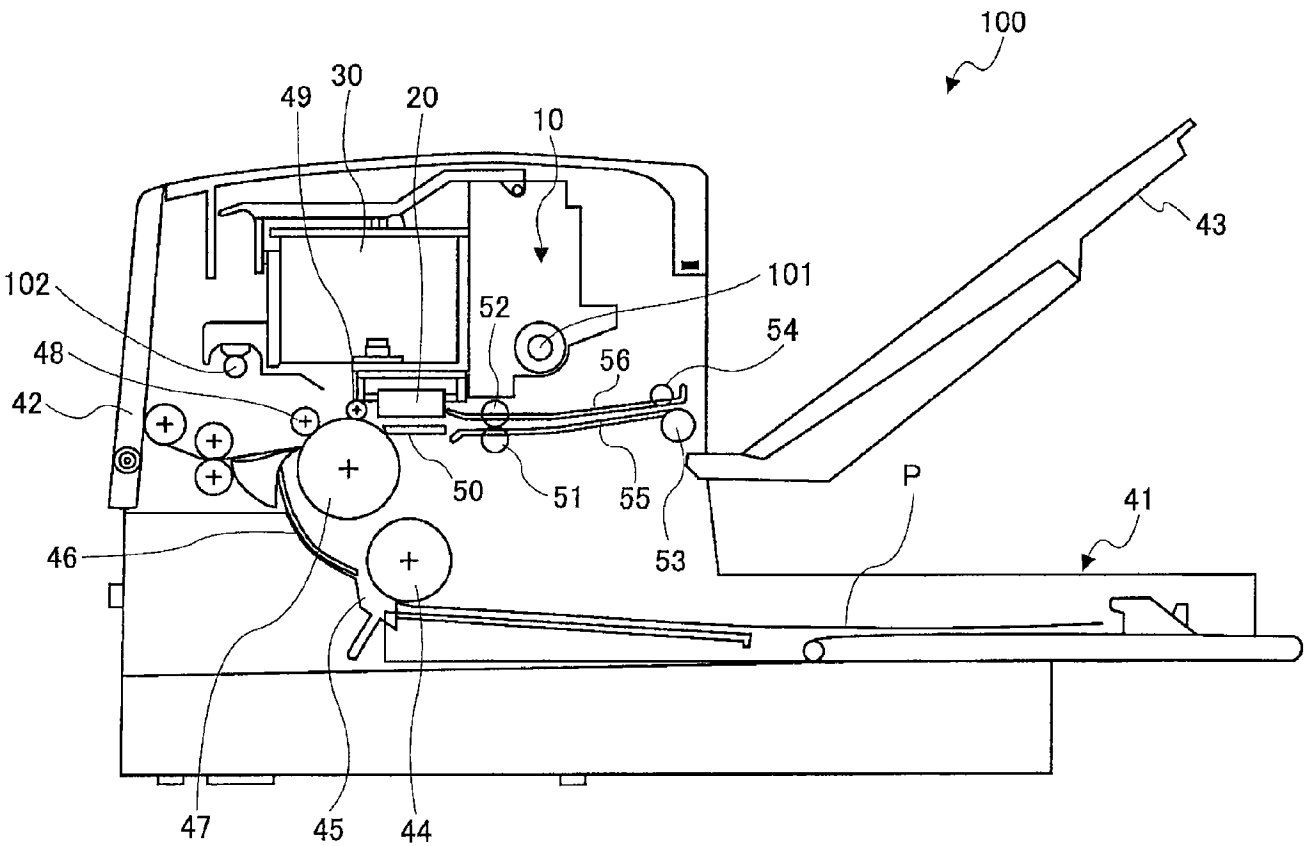
FIG. 2 is a side view from the sub-scanning direction of the internal structure of the inkjet recording apparatus according to an embodiment of the present invention.

FIG. 2 is a side view from the sub-scanning direction of the internal structure of the inkjet recording apparatus according to an embodiment of the present invention.

An inkjet recording apparatus 100 according to an embodiment of the present invention has a carriage 10 that is movable in the main scanning direction, a recording head 20 that is detachably mounted to the carriage 10, and ink cartridges 30 that are mounted to the carriage 10 and are configured to supply ink to the recording head 20. The inkjet recording apparatus 100 has a paper feed cassette 41 (or a paper feed tray) arranged at its bottom side on which multiple sheets of paper (image recording medium) P may be stacked. The inkjet recording apparatus 100 also has a manual feed tray 42 for manually feeding paper P. By turning the manual feed tray 42 towards the front side (left side in FIG. 2) from its position shown in FIG. 2, paper P may be fed via the manual feed tray 42. Paper P fed from the paper feed cassette 41 or the manual feed tray 42 is transported to a printing mechanism portion via a corresponding transport path. At the printing mechanism portion, an image is recorded on the paper P with ink discharged from the recording head 20. Then, the paper P with the image recorded thereon is delivered to a paper delivery tray 43 arranged at the back side (right side in FIG. 2) of the inkjet recording apparatus 100.

The printing mechanism portion has a main guide rod 101 and a subordinate guide rod 102 as guide members arranged across side boards of the inkjet recording apparatus 100 (not shown; board members arranged at the front and back inner sides of the inkjet recording apparatus 100 in FIG. 2). The main guide rod 101 and the subordinate guide rod 102 slidably hold the carriage 10 so that the carriage 10 may move in the main scanning direction. The carriage 10 detachably holds the recording head 20, which has color nozzle groups (ink discharge outlet groups) that discharge ink droplets in the colors yellow (Y), cyan (C), magenta (M), and black (Bk). The color nozzle group of each color is arranged in a traverse direction with respect to the main scanning direction to form a nozzle row. The recording head 20 is mounted on the carriage 10 in a manner such that a nozzle face of the recording head 20 on which the color nozzles are arranged face downward in a vertical direction.

The carriage 10 detachably holds ink cartridges 30 that supply ink in various colors to the recording head 20. The ink cartridge 30 has a vent hole arranged on the upper side that is in communication with the air, a supply hole at the lower side that supplies ink to the recording head 20, and a porous body arranged inside that is filled with ink. The capillary force of the porous body maintains the ink supplied to the recording head 20 at a slightly negative pressure. It is noted that in the above exemplary embodiment, nozzles for discharging inks of various colors are arranged in one single recording head. However, the present invention contemplates other configurations including one in which a recording head corresponding to each individual color is provided.

In one preferred embodiment of the present invention, the rear side of the carriage 10 (downstream side of the paper transport direction) is slidably engaged to the main guide rod 101, and the front side of the carriage 10 (upstream side of the paper transport direction) is slidably mounted on the subordinate guide rod 102. A timing belt 106 is suspended between a drive pulley 104 that is rotated by a main scanning motor 103 and a driven pulley 105, and the carriage 10 is fixed on the timing belt 106. Through forward-reverse rotation of the main scanning motor 103, the carriage 10 may be moved back and forth along the main guide rod 101 and the subordinate guide rod 102 to perform scanning in the main scanning direction.

In another preferred embodiment for transporting the paper P set to the paper feed tray 41 to the bottom side of the recording head 20, the inkjet recording apparatus 100 includes a paper feed roller 44 and a friction pad 45 for separately feeding the paper P from the paper feed cassette 41, a guide member 46 that guides the paper P, a transport roller 47 for reversing and transporting the paper P, a transport collar 48 that is pressed against the peripheral face of the transport roller 47, and a tip collar 49 that determines the angle of the paper P sent out from the transport collar 48. The transport roller 47 is rotated by a sub-scanning motor 107 via a gear row (not shown).

The paper P is sent out from the transport roller 47 in accordance with the main scanning direction movement range of the carriage 10 and is transported on a print receiving member 50, which is a sheet guiding member for guiding the paper P along the bottom side of the recording head 20. The paper P is then moved beneath and past the recording head 20. At the paper transport direction downstream side of the print receiving member 50, a transport collar 51 that is rotated to send out the paper P in the paper delivery direction, a spur 52 that is arranged to face the transport collar 51, delivery rollers 53 and 54 that send out the paper P to the delivery tray 43, and guide members 55 and 56 that form a paper delivery path are arranged.

To record an image, the recording head 20 is driven according to an image signal while the carriage 10 moves in the main scanning direction. Ink droplets are discharged onto paper P while the paper P is at a standstill so that an image of one line is recorded. Then, the paper P is transported by a predetermined amount and the next line is recorded. Upon receiving a recording stop signal or a signal indicating that the transport direction rear end of the paper P has reached the recording area of the print mechanism portion, the image recording operation is terminated and the paper P is discharged.

In one preferred embodiment of the present invention, as is shown in FIG. 1, a restoration unit 110 for performing one or more procedures for correcting discharge defects of the recording head 20 is arranged at one side in the moving direction of the carriage 10 (main scanning direction) at a location outside the recording area. The restoration unit 110 includes capping means, suction means, and a wiping member as cleaning means. When the inkjet recording apparatus 100 is in print standby mode, for example, the carriage 10 may move to a position facing the restoration unit 110, and the capping means may cap the nozzle face of the recording head 20. In this way, the dampness of the nozzles may be maintained to thereby prevent discharge defects due to the drying of ink within the nozzles. Also, during consecutive image recording operations, for example, ink that is not used in the image recording operations may be discharged at the restoration unit 110 (dummy discharge) so that the ink viscosity at the discharge outlets may be maintained at a certain level and stable discharge performance may be ensured. Additionally, when discharge defects occur, for example, the capping means may cap and seal off the nozzles of the recording head 20 and the suction means may suction out ink and air bubbles from the nozzles via a tube. Further, the wiping member as cleaning means may remove ink and other dirt adhered to the nozzle face of the recording head 20, for example. By performing one or more of the above procedures, discharge defects may be corrected and discharge properties of the recording head 20 may be restored. In one preferred embodiment, the ink suctioned from the nozzle face may be discharged to a disposed ink reservoir (not shown) arranged at the bottom of the inkjet recording apparatus 100, and the ink may be absorbed and retained by an ink absorbing body that is arranged inside the disposed ink reservoir.

In the following, the internal configuration of the recording head 20 according to an embodiment of the present invention is described.

Figure 3:
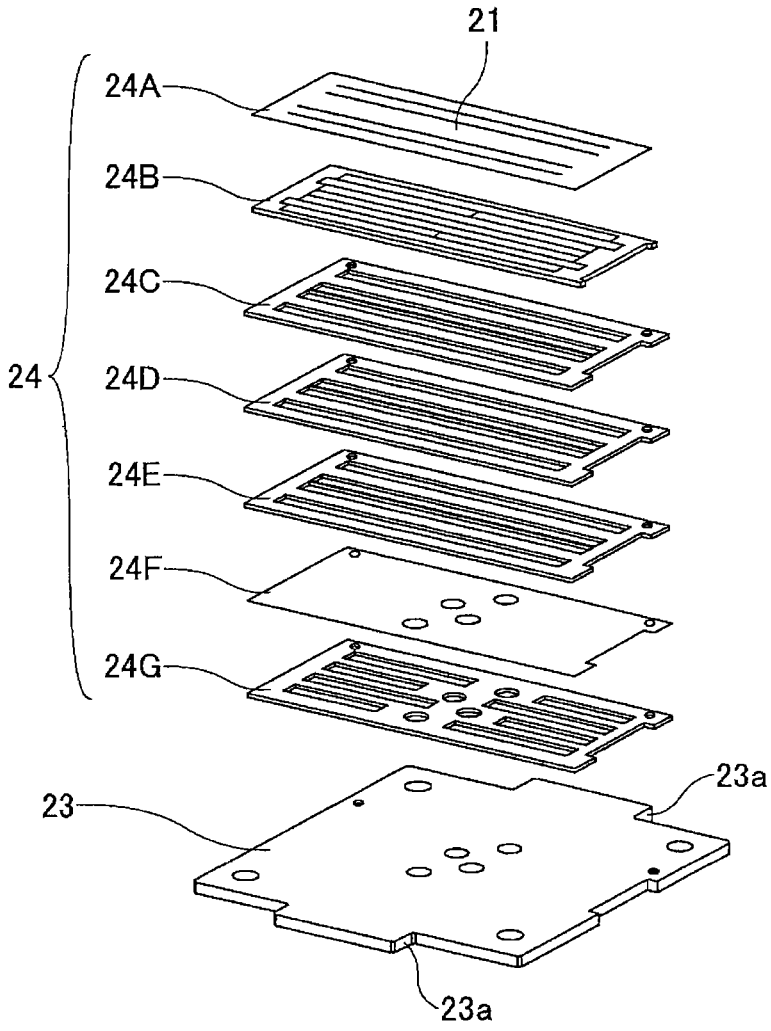
FIG. 3 is an exploded perspective view showing component members of a recording head of the inkjet recording apparatus according to an embodiment of the present invention.

FIG. 3 is an exploded perspective view showing component members of the recording head 20 according to an embodiment of the present invention.

As is shown in FIG. 3, the recording head 20 has a recording head chip 24, which includes a nozzle plate 24A that has plural nozzles (ink discharge outlets) for discharging ink droplets; an individual flow path substrate 243 that has plural individual liquid chambers for supplying ink to the nozzles, vibrating plates for pressurizing the individual liquid chambers, and electromechanical transduction elements that are made up of lower electrodes, piezoelectric bodies, and upper electrodes arranged on the vibrating plates; plural common flow path substrates 24C-24E for supplying ink to the individual liquid chambers; and damper members 24F and 24G for suppressing residual fluid vibrations within common liquid chambers. It is noted that the outer face of the nozzle plate 24A corresponds to nozzle face 21.

In the present embodiment, the nozzle plate 24A has plural nozzles arranged into four nozzle rows corresponding to the colors yellow (Y), cyan (C), magenta (M), and black (Bk). Further, the recording head 20 has an electromechanical transduction element and an ink supply path corresponding to each nozzle row and is configured to be capable of discharging inks in four different colors. In one preferred embodiment, the electromechanical transduction element may be fabricated by performing a film formation process using the sol-gel process (described below) and a semiconductor process. In this way, high densification of the electromechanical transduction elements may be facilitated. For example, a piezoelectric element that is driven using the bending mode may be suitably used as the electromechanical transduction element.

The sol-gel process is an inorganic oxide fabrication method that involves causing hydrolysis and polycondensation reactions of metallic organic compounds such as metal alkoxides in a solution system to promote growth of a metal-oxo-metal network, and ultimately performing a thermal treatment thereon. K. D. Budd, S. K. Dey, D. A. Payne, Proc. Brit. Ceram. Soc. 36, 107 (1985). In one preferred embodiment, lead zirconate titanate (PZT) materials that are fabricated using lead acetate, zirconium isopropoxide, and titanium isopropoxide as precursors, and dissolving these precursors in methoxyethanol as the common solvent may suitably be used as the piezoelectric material for the electromechanical transduction elements.

It is noted that the present invention is not limited to embodiments using the electromechanical transduction elements as described above. Rather, the present invention contemplates the use of other various publicly known pressure boosting means for boosting the pressure of ink within individual liquid chambers (pressure chambers).

Figure 4:
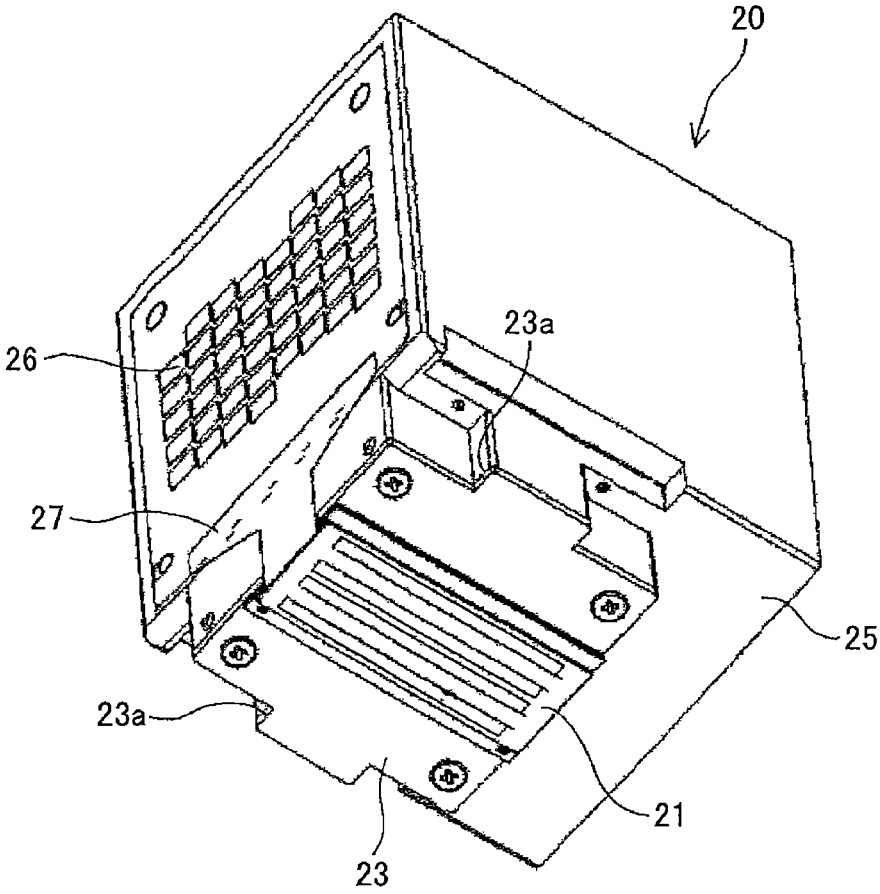
FIG. 4 is an external perspective view from a lower-diagonal angle of the recording head according to an embodiment of the present invention.

FIG. 4 is an external perspective view from a lower-diagonal angle of the recording head 20 according to an embodiment of the present invention.

In the recording head 20 according to the present embodiment, the recording head chip 24 that drives the electromechanical transduction elements to discharge ink from the nozzles is arranged on a base plate 23. The recording head 20 has a housing 25 that houses the base plate 23 and an ink cartridge (not shown), a connector substrate 26 that has plural electric pads that are electrically connected to connectors (not shown) are arranged at the carriage 10, and flexible printed circuits 27 that receive an electrical signal corresponding to a recording image via the connector substrate 26 and transmit the electric signal to pads arranged at the recording head chip 24.

An electrical signal transmitted from a control unit of the inkjet recording apparatus 100 according to a recording image is transmitted via the connector substrate 26 and the flexible printed circuits 27 to the electromechanical transduction elements arranged on the recording head chip 24. In this way, the electromechanical transduction elements may be driven and the electrical signal may be converted into mechanical vibrations of the vibration plates. In turn, ink within the individual liquid chambers may be pressurized by the mechanical vibrations of the vibration plates so that ink droplets may be discharged from the nozzles. It is noted that the recording head chip 24 and the flexible printed circuits 27 are thin members having thicknesses of only a few dozen micrometers so that they lack adequate mechanical strength and are very fragile. However, in the present embodiment, the recording head chip 24 and the flexible printed circuits 27 are protected by a head cover 12 (shown in FIG. 5) so that contact with paper P or contact with the wiping member of the restoration unit 110 may be avoided. In this way, reliability of the inkjet recording apparatus 100 may be secured.

In the following, the carriage 10 and the recording head 20 according to further aspects of the present invention are described.

Figure 5:
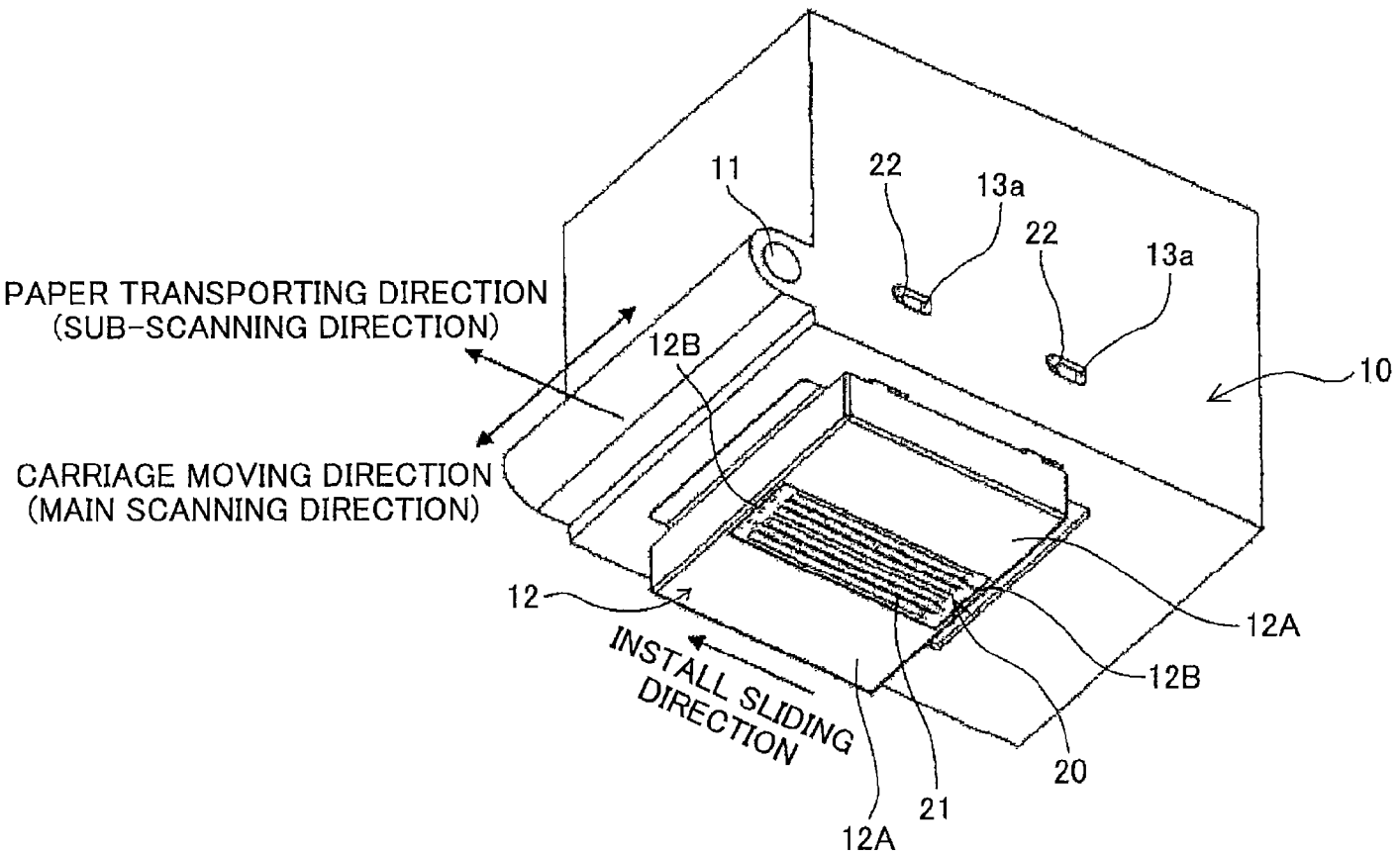
FIG. 5 is an external perspective view from a lower-diagonal angle of a carriage having the recording head installed.

FIG. 5 is an external perspective view from a lower-diagonal angle of the carriage 10 having the recording head 20 installed.

Figure 6:
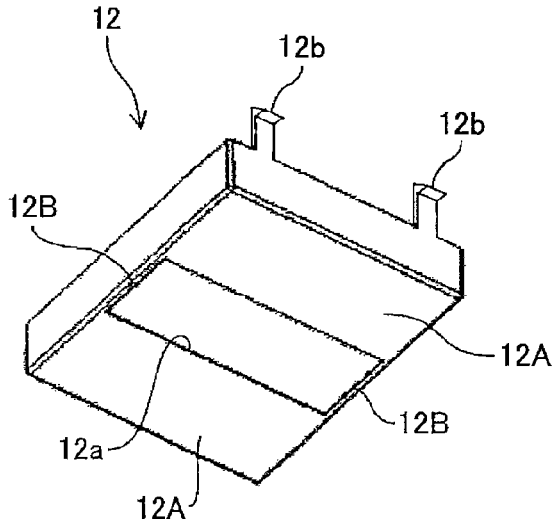
FIG. 6 is a perspective view from a lower-diagonal angle of a head cover that is attached to the carriage.

FIG. 6 is a perspective view from a lower-diagonal angle of the head cover 12 that is attached to the carriage 10.

Figure 7:
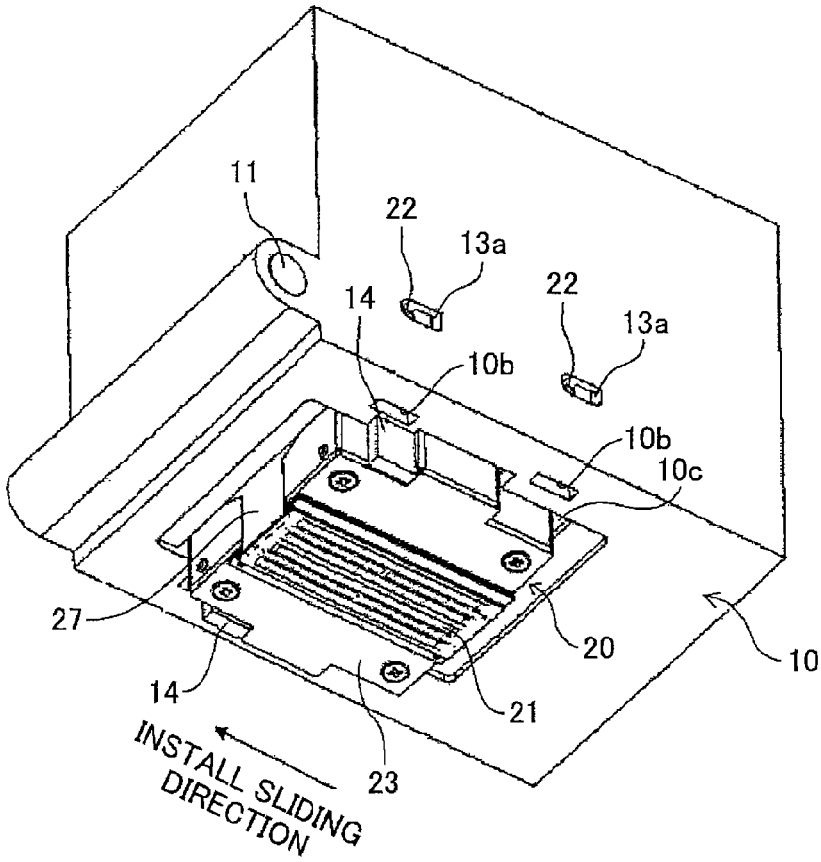
FIG. 7 is a perspective view from a lower-diagonal angle of the carriage having the recording head installed and the head cover detached.

FIG. 7 is a perspective view from a lower-diagonal angle of the carriage 10 having the recording head 20 installed and the head cover 12 detached.

In the present embodiment, the carriage 10 has a guide rod engaging portion 11 through which the main guide rod 101 of the inkjet recording apparatus 100 may be inserted so that the carriage 10 may be slidably supported by the main guide rod 101. As is shown in FIG. 5, the carriage 10 according to the present embodiment has a head cover 12 as a head protection member surrounding the four sides of the nozzle face 21 of the recording head 20. The head cover 12 has an opening 12*a* at its bottom so that the nozzle face 21 of the recording head 20 may be exposed from this opening 12*a*. It is noted that the head cover 12 is configured such that its outer face protrudes further than the nozzle face 21 of the recording head 20.

The head cover 12 includes main scanning direction cover portions 12A that are arranged near or adjacent to both sides in the carriage moving direction (main scanning direction) of the nozzle face 21 and sub-scanning direction cover portions 12B arranged near or adjacent to both sides in the paper transporting direction intersecting the main scanning direction (sub-scanning direction) of the nozzle face 21. By arranging the main scanning direction cover portions 12A and the sub-scanning direction cover portions 12B in the main scanning direction and the sub-scanning direction near the nozzle face 21, even when paper P has a folded portion, the cover portions 12A and 12B may block the folded portion and prevent the folded portion from coming into contact with the nozzle face 21 of the recording head 20.

By arranging the sub-scanning direction cover portions 12B near the two opposing sides of the nozzle face 21 in the paper transporting direction (sub-scanning direction), the distance between the sub-scanning direction cover portions 12B (sub-scanning direction distance) may be relatively narrow. In turn, the distance (sub-scanning direction distance) between tip collar 49 and spur 52 as paper pressing members arranged at the two opposing sides of the recording head 20 in the paper transporting direction (sub-scanning direction) may be relatively narrow. In this way, the portion of the paper P positioned between the tip collar 49 and the spur 52; namely, the portion of the paper P positioned beneath the recording head 20, may be prevented from rising.

The head cover 12 according to the present embodiment is slidably mounted on the carriage 10 so that it may slide back and forth in the sub-scanning direction (the sliding direction of the recording head 20 upon being installed; install sliding direction). The head cover 12 may be mounted to the carriage 10 by inserting four mounting foot portions 12*b* arranged at the head cover 12 (shown in FIG. 6) into corresponding mounting hole portions 10*b* arranged at the carriage 10 (shown in FIG. 7). The tips of the foot portions 12*b* of the head cover 12 have hook portions that hook into the bottom inner wall of the carriage 10 so that the head cover 12 may be mounted to the carriage 10. The sub-scanning direction (install sliding direction) length of the hole portions 10*b* of the carriage 10 is arranged to be longer than the sub-scanning direction (install sliding direction) length of the mounting foot portions 12*b* of the head cover 12. In this way, the head cover 12 mounted to the carriage 10 may slide along the lengthwise directions of the mounting foot portions 12*b*; i.e., the sub-scanning direction.

FIG. 8 is a perspective view from a lower-diagonal angle of the carriage 10 and the recording head 20 before the recording head 20 is installed into the carriage 10. It is noted that in FIG. 8, the head cover 12 is omitted.

The top side of the carriage 10 has a top opening portion 10*a* for installing and removing the recording head 20. In FIG. 8, the peripheral edges of the top opening portion 10*a* of the carriage 10 are partially hatched. During normal operations, the top opening portion 10*a* is closed off by an ink cartridge holder (not shown) that holds the ink cartridge 30. The recording head 20 may be installed into the carriage 10 by opening the cartridge holder and inserting the recording head 20 from the top opening portion 10*a* of the carriage 10 and lowering the recording head 20 in a vertical direction from the upper side.

The recording head 20 has two guide pins 22 arranged at each of its main scanning direction sides (front and rear sides in FIG. 8). The carriage 10 has four guide slots 13 corresponding to the guide pins 22 arranged at its main scanning direction inner walls (front and rear side inner walls in FIG. 8). In FIG. 8, one of the guide slots 13 is illustrated by dashed lines, but the other guide slots 13 are omitted. In the present embodiment, the recording head 20 may be installed into the carriage 10 from the top opening portion 10*a* by arranging the guide pins 22 of the recording head 20 to enter the corresponding guide slots 13 of the carriage 10 and lowering the recording head 20 from the top opening portion 10*a* of the carriage 10 in a vertical direction. In this way, the recording head 20 may be guided by the guide slots 13 and inserted into the carriage 10 until it reaches a position at which the nozzle face 21 of the recording head 20 slightly protrudes from the bottom opening portion 10*c* of the carriage 10 (insertion complete position).

The recording head 20 has two position reference planes 23*a* that are used for positioning the recording head 20 with respect to the carriage 10 in the sub-scanning direction. The position reference planes 23*a* of the recording head 20 are arranged at the base plate 23, which accommodates nozzles. By arranging the position reference planes 23*a* and the nozzles on the same member; i.e., the base plate 23, position accuracy of the nozzles with respect to the carriage 10 may be achieved and landing position accuracy of ink droplets discharged from the nozzles onto paper P may be ensured.

When the recording head 20 is inserted into the carriage 10 to the insertion complete position, the position reference planes 23*a* are positioned outside the bottom opening portion 10*c* of the carriage 10. The bottom of the carriage 10 has two position reference pins 14 with position reference planes 14*a* corresponding to the position reference planes 23*a* of the recording head 20. By sliding the recording head 20 inserted to the insertion complete position in the install sliding direction (in the sub-scanning direction towards the main guide rod 101), the position reference planes 23*a* of the recording head 20 come into contact with the corresponding position reference planes 14*a* of the position reference pins 14.

The bottom end portions of the guide slots 13 have horizontally long hole portions 13*a* extending in the install sliding direction so that the recording head 20 that has been inserted to the insertion complete position may slide in the install sliding direction. By sliding the recording head 20 that has been inserted to the insertion complete position in the install sliding direction until it reaches a point at which the position reference planes 23*a* of the recording head 20 come into contact with the position reference planes 14*a* of the carriage 10, the guide pins 22 of the recording head 20 may be interposed between the upper and lower walls of the horizontally long hole portions 13*a* so that vertical movement of the recording head 20 with respect to the carriage 10 may be restricted. In the present embodiment, the horizontally long hole portions 13*a* are arranged to penetrate through the side walls of the carriage 10 so that it may be perceived from the outside whether the guide pins 22 are locked by the horizontally long hole portions 13*a*.

By arranging the guide pins 22 of the recording head 20 to be interposed between the upper and lower walls of the horizontally long hole portions 13*a*, the recording head 20 may be provisionally attached to the carriage 10 at a position where the position reference planes 23*a* and 14*a* are in contact with each other. Then, the ink cartridge holder (not shown) may be closed, and in conjunction with this closing motion, push members arranged at the ink cartridge holder may push the recording head 20 in the install sliding direction. By completely closing the cartridge holder, the recording head 20 may be locked to the carriage 10 with the position reference planes 23*a* and 14*a* held in contact with each other. In this way, positioning of the recording head 20 with respect to the carriage 10 in the sub-scanning direction may be completed.

In the present embodiment, when the recording head 20 is inserted into the carriage 10 to the insertion complete position, the recording head 20 is fit inside the head cover 12 that is attached to the bottom of the carriage 10, and the nozzle face 21 of the recording head 20 is exposed from the opening portion 12*a* of the head cover 12. The head cover 12 receives bias from biasing means (not shown) in a direction opposite the install sliding direction and is positioned such that the recording head 20 may enter into the head cover 12 when the recording head 20 is inserted to the insertion complete position. As is described above, in the present embodiment, the head cover 12 is slidably mounted to the carriage so that the head cover 12 may move in the install sliding direction. Thus, when the recording head 20 that is fit into the head cover 12 is slid in the install sliding direction, the head cover 12 also slides in the install sliding direction along with the recording head 20 against the bias force of the bias means.

When recording head 20 is locked to the carriage 10 with the position reference planes 23*a* and 14*a* in contact with each other, the head cover 12 is pushed to the recording head 20 in the sub-scanning direction by the bias force of the bias means. In this way, the head cover 12 may also be locked.

In the present embodiment, in order to avoid exposure of the position reference planes 23*a* of the base plate 23 of the recording head 20 and the position reference planes 14*a* of the carriage 10, the head cover 12 is configured to cover the portion of the recording head 20 protruding from the bottom opening portion 10*c* of the carriage 10. In this way, the head cover 12 may prevent the wiping member that wipes ink from the nozzle face 21 from coming into contact with the position reference planes 14*a* and 23*a*, prevent ink mist generated by the discharge of ink from the nozzles from adhering to the position reference planes 14*a* and 23*a*, and prevent other foreign matter from adhering to the position reference planes 14*a* and 23*a*, for example. By using the head cover 12 to prevent foreign matter such as ink from adhering to the position reference planes 14*a* and 23*a*, the degradation of positioning accuracy due to the presence of foreign matter between the position reference planes 14*a* and 23*a* may be avoided.

In a preferred embodiment of the present invention, a hard-to-adhere material to which ink does not easily adhere, that has solvent tolerance, may be used for the head cover 12. Further, a material with relatively low surface energy is preferably used. For example, polypropylene, polyethylene, a fluorocarbon polymer such as polytetrafluoroethylene, or an inorganic material with a fluorocarbon polymer film or a silicone film formed on its surface may be used for the head cover 12.

In the following, further illustrative modes and aspects of the present invention are described.

(Mode A)

An inkjet recording apparatus 100 is provided that includes a recording head 20 configured to discharge ink; a carriage 10 to which the recording head is detachably mounted, the carriage being configured to move along a direction (main scanning direction) that intersects a recording medium transporting direction (sub-scanning direction) for a recording medium such as paper P; and a first head protection member such as sub-scanning direction cover portions 12B that is arranged on the carriage 10; wherein the recording head 20 is positioned with respect to the carriage 10 in a relative movement direction by moving the recording head 20 relative to the carriage 10 until a first position reference plane 23*a* arranged at the recording head 20 and a second position reference plane 14*a* arranged at the carriage 10 come into contact; the first head protection member is arranged at both sides in the relative movement direction (sub-scanning direction) of a nozzle face 21 of the recording head 20 and is arranged to protrude further than the nozzle face 21; and the first head protection member is configured to be movable with respect to the carriage 10 in the relative movement direction and is configured to move along with the recording head 20 when the recording head 20 moves relative to the carriage 10 until the first position reference 23*a* and the second reference plane 14*a* come into contact.

According to an aspect of the present invention, when the recording head 20 is moved relative to the carriage 10 to arrange the position reference plane 23*a* of the recording head 20 and the position reference plane 14*a* of the carriage 10 to come into contact, the first head protection member such as the head cover 12 may also be moved relative to the carriage 10 along with the relative movement of the recording head 20. In this way, the head protection member may not interfere with the relative movement of the recording head 20 so that the relative movement range of the recording head 20 may not be restricted. In turn, the distance between the head protection members (sub-scanning direction cover portions 12B) arranged at both sides in the relative movement direction of the nozzle face 21 may be arranged to be relatively narrow so that a desirable head protection effect of the head protection members may be secured.

(Mode B)

In the inkjet recording apparatus of Mode A, the relative movement direction intersects a moving direction of the carriage 10 (main scanning direction).

According to an aspect of the present mode, even when there is a mound-shaped folded portion on the image recording medium such as paper P as viewed from the direction (sub-scanning direction) intersecting the main scanning direction, the folded portion may be prevented from coming into contact with the nozzle face 21 of the recording head 20.

(Mode C)

The inkjet recording apparatus of Mode A or B further includes a second head protection member such as main scanning direction cover portions 12A that are arranged on the carriage 10, the second head protection member being arranged at both sides in an orthogonal direction (main scanning direction) with respect to the relative movement direction (sub-scanning direction) of the nozzle face 21 and being arranged to protrude further than the nozzle face 21.

According to an aspect of the present mode, even when there is a folded portion on the image recording medium at the front in the carriage scanning direction while the carriage 10 is scanned, the folded portion may be prevented from coming into contact with the nozzle face 21 of the recording head 20.

(Mode D)

The inkjet apparatus of one of Modes A-C further includes a head protection member fixing part such as a cartridge holder that is configured to fix the head protection member after the head protection member has moved along with the relative movement of the recording head 20 and the first position reference plane 23*a* and the second position reference plane 14*a* have come into contact.

According to an aspect of the present mode, backlash of the head protection member during scanning of the carriage 10 may be prevented.

(Mode E)

In the inkjet recording apparatus of one of Modes A-D, further includes an opening portion such as bottom opening portion 10*c* arranged at the bottom of the carriage 10, the opening portion 10*c* being configured to expose the nozzle face 21 of the recording head 20; and a head installation guide part such as guide pins 22 and guide slots 13 that are configured to guide the recording head from an upper side to a provisional positioning spot at a lower side where the nozzle face 21 of the recording head 20 is exposed from the opening portion 10*c* of the bottom of the carriage 10; wherein the recording head 20 is guided to the provisional positioning spot by the head installation guide part after which the recording head 20 is moved in the relative movement direction (sub-scanning direction) so that the first position reference plane 23*a* and the second position reference plane 14*a* come into contact.

According to an aspect of the present mode, the recording head 20 may be easily mounted to and detached from the carriage 10.

(Mode F)

In the inkjet recording apparatus of one of Modes A-E, a material to which ink is more difficult to adhere than the carriage is used for the head protection member.

According to an aspect of the present mode, the head protection member is configured to move relative to the carriage 10 and the head protection member is a separate member from the carriage 10. Thus, the head protection member and the carriage 10 may be separately fabricated using suitable materials according to their respective functions. For example, the carriage 10 is preferably made of a rigid material so that it may be able to adequately support the recording head 20 and the ink cartridges 30 even during scanning operations. However, the head protection member does not require so much rigidity. On the other hand, the head protection member is preferably made of a hard-to-adhere material to which ink does not easily adhere in order to prevent the image recording medium from being tainted when the head protection member comes into contact with the image recording medium.

(Mode G)

In the inkjet recording apparatus of Mode F, the head protection member is made of polypropylene, polyethylene, or fluorocarbon polymer.

According to an aspect of the present mode, ink may be adequately prevented from adhering to the head protection member.

(Mode H)

In the inkjet recording apparatus of one of Modes A-G, the recording head 20 includes a nozzle that discharges ink, a pressure chamber that is in communication with the nozzle, and an electromechanical transduction element configured to boost the pressure of ink within the pressure chamber.

According to an aspect of the present mode, accurate ink discharge control may be enabled.

(Mode I)

In the inkjet recording apparatus of Mode H, the electromechanical transduction element is a piezoelectric element that is driven using a bending mode.

According to an aspect of the present mode, accurate ink discharge control may be enabled with a simplified configuration.

(Mode J)

In the inkjet recording apparatus of Mode H or I, the electromechanical transduction element is fabricated using a sol-gel process.

According to an aspect of the present mode, the electromechanical transduction element suitably fabricated.

It is noted that the present invention has been illustrate by way of exemplary embodiments. However, the present invention is not limited to these embodiments, and various variations and modifications may be made without departing from the scope of the present invention.

The present application is based on Japanese priority application No. 2011-202989 filed on Sep. 16, 2011, with the Japanese Patent Office, the entire contents of which are hereby incorporated by reference.

What is claimed is:

1. An inkjet recording apparatus comprising:

a recording head configured to discharge ink;

a carriage to which the recording head is detachably mounted, the carriage being configured to move along a direction that intersects an image recording medium transporting direction; and a first head protection member that is arranged on the carriage;

wherein the recording head is positioned with respect to the carriage in a relative movement direction by moving the recording head relative to the carriage until a first position reference plane arranged at the recording head and a second position reference plane arranged at the carriage come into contact;

the first head protection member is arranged at both sides in the relative movement direction of a nozzle face of the recording head and is arranged to protrude farther than the nozzle face in an ink discharging direction of the recording head when the first position reference plane and the second position reference plane are in contact; and the first head protection member is configured to be movable with respect to the carriage in the relative movement direction and is configured to move along with the recording head when the recording head moves relative to the carriage until the first position reference plane and the second position reference plane come into contact.

2. The inkjet recording apparatus as claimed in claim 1, wherein the relative movement direction intersects a moving direction of the carriage.

3. The inkjet recording apparatus as claimed in claim 1, further comprising:

a second head protection member that is arranged on the carriage, the second head protection member being arranged at both sides in an orthogonal direction with respect to the relative movement direction of the nozzle face and being arranged to protrude farther than the nozzle face in the ink discharging direction of the recording head.

4. The inkjet recording apparatus as claimed in claim 1, further comprising:

a head protection member fixing part configured to fix the first head protection member after the head protection member has moved along with the relative movement of the recording head and the first position reference plane and the second position reference plane have come into contact.

5. The inkjet recording apparatus as claimed in claim 1, further comprising:

an opening portion arranged at a bottom of the carriage, the opening portion being configured to expose the nozzle face of the recording head; and a head installation guide part configured to guide the recording head from an upper side to a provisional positioning spot at a lower side where the nozzle face of the recording head is exposed from the opening portion of the bottom of the carriage;

wherein the recording head is guided to the provisional positioning spot by the head installation guide part after which the recording head is moved in the relative movement direction so that the first position reference plane and the second position reference plane come into contact.

6. The inkjet recording apparatus as claimed in claim 1, wherein the first head protection member is made of at least one of polypropylene, polyethylene, and fluorocarbon polymer.

7. The inkjet recording apparatus as claimed in claim 1, wherein the recording head includes a nozzle that discharges ink, a pressure chamber that is in communication with the nozzle, and an electromechanical transduction element configured to boost the pressure of ink within the pressure chamber.

8. The inkjet recording apparatus as claimed in claim 7, wherein the electromechanical transduction element is a piezoelectric element that is driven using a bending mode.

* * * * *